United States Patent [19]

Spielau et al.

[11] 4,368,604

[45] Jan. 18, 1983

[54] INSULATING PANEL FOR ROOF COVERINGS

[75] Inventors: Paul Spielau, Troisdorf; Peter Pütz, Augustin; Richard Weiss, Troisdorf, all of Fed. Rep. of Germany; Hansfritz Schraube, deceased, late of Happerschoss, Fed. Rep. of Germany, by Maria K. Schraube, heir

[73] Assignee: Dynamit Nobel Aktiengesellschaft, Troisdorf, Fed. Rep. of Germany

[21] Appl. No.: 250,218

[22] Filed: Apr. 2, 1981

Related U.S. Application Data

[62] Division of Ser. No. 33,840, Apr. 27, 1979, Pat. No. 4,282,697.

[30] Foreign Application Priority Data

Apr. 27, 1978 [DE] Fed. Rep. of Germany ..... 2818485

[51] Int. Cl.[3] ..... E04B 5/00; E04D 1/28

[52] U.S. Cl. ..... 52/309.8; 52/411; 52/420; 52/592; 428/316.6

[58] Field of Search ..... 156/82, 71; 428/319.1, 428/314.4, 314.8, 316.6; 52/309.9, 592, 309.8, 309.4, 420, 408, 409

[56] References Cited

U.S. PATENT DOCUMENTS

| | | | |
|---|---|---|---|
| 3,093,935 | 6/1963 | Dunn | 52/593 |
| 3,862,527 | 1/1975 | Peterson | 52/309.9 |
| 4,044,520 | 8/1977 | Barrows | 52/592 |
| 4,147,828 | 4/1979 | Heckel | 428/314.4 |
| 4,162,597 | 7/1979 | Kelly | 52/592 |

*Primary Examiner*—John E. Murtagh
*Attorney, Agent, or Firm*—Antonelli, Terry and Wands

[57] ABSTRACT

An insulating panel suitable for the covering of roof structures includes a core layer of a synthetic foam material bonded adhesively on its top side to a sealing thermoplastic layer. The core layer is formed of an elastic closed-cell crosslinked polyolefin foamed material.

7 Claims, 6 Drawing Figures

INSULATING PANEL FOR ROOF COVERINGS

This is a division of application Ser. No. 033,840 filed Apr. 27, 1979, now U.S. Pat. No. 4,282,697.

The invention relates to an insulating panel with a core layer of synthetic foam material, bonded throughout its area on the topside of a sealing, thermoplastic layer or sheet, for the covering of roofs, and to a process for the production of a roof with such insulating panels.

Heretofore, insulating panels of hard foam materials, such as polystyrene or polyurethane are loosely laid underneath and/or on top of a roofing skin made of a synthetic resin or formed of a bituminous base material. This roofing skin takes care of the sealing function, thus ensuring venting and the escape of moisture. Such heat insulating panels suitable for flat or slightly inclined roofs are described, for example, in German Utility Model No. 1,826,389. DOS (German Unexamined Laid-Open Application No. 1,709,005 discloses heat-insulating building elements or components for covering flat roofs which comprise, in addition to a core layer of a hard foam material, a sealing synthetic resin sheet laminated to the topside of the foam layer. These building elements are additionally fashioned to be staggered along their lateral edges, so that they can be laid, to form the roof, at least partially in shape-mating, adjoining relationship, wherein a mechanical bond to the base is provided by additional mechanical anchoring means provided at various points. Moreover, it is also known to laminate the heat-insulating elements on both sides with a synthetic resin sheet projecting beyond the edges of the elements and thus making possible a connection with the adjacent element; see, for example, DOS No. 2,619,020.

Moreover, it has also been known to adhere panel-shaped insulating elements to the roof cover by means of neat cement, dispersion adhesives, or the like, or by means of bitumen. The use of bitumen holds true, in particular, for ungraveled roofs, so that a lifting off of the insulating elements by the effects of wind is avoided.

All of these conventional heat-insulating elements for roof converings possess a stiff core of a hard synthetic foam material, preferably on the basis of polystyrene or polyurethane. As long as the insulating elements are merely laid loosely, optionally in shape-mating relationship, side-by-side on a roof, the elements serve exclusively for heat insulation and have no influence with regard to the tightness of the roof covering. This holds true the more so since the joints between the adjacent insulating panels are not sealingly closed but rather the insulating panels are frequently laid so that spacings are present between the joints. Moreover, however, insulating elements are likewise known with a synthetic resin sheet laminated to one or both sides thereof, which are used for the economical manufacture of flat roofs and wherein on one or both sides the synthetic resin sheets of the adjoining insulating elements are sealingly connected to form a closed roofing skin. Also in these laminated insulating panels, the hard foam cores remain in loosely laid, side-by-side relationship and take on exclusively a heat-insulating and venting function.

On the other hand, attempts have been made also to join the insulating panels mechanically to the substrate, so that no graveling needs to be provided. However, in this connection, it was found to be disadvantageous that, due to the high alternating temperature stresses to which the roofs are subjected due to weather influences, high tensile and compressive stresses are built up in the insulating panels of hard foam mechanically connected to the substrate. Thus, insofar as the insulating panels were mechanically joined to the base structure, it was necessary to leave at least the necessary movability for the adjoining insulating panels in their butt joints. However, this means that the heat-insulating core layers of the conventional insulating panels do not contribute anything to the sealing function for the roof; rather, they simply serve to provide heat insulation.

The invention is based on the object of creating an insulating panel for roof coverings which, with an increased sealing function and thus with an enhanced safety function, makes it possible to produce roofs in an economical fashion.

This object has been attained according to the invention in the form of an insulating panel, the core layer of which is made from an elastic, closed-cell, crosslinked polyolefin foam material. The polyolefin foam materials utilized according to the invention are not prone to hydrolysis and practically absorb no water at all, so that a first prerequisite for taking over a sealing function by the heat-insulating core layer has thus been accomplished. Furthermore, the polyolefin foam materials used according to this invention are soft-elastic to elastic, so that they absorb the tensile and compressive stresses occurring due to alternating temperature loads even in case of a mechanical bond, on the basis of their elasticity and pressure deformation absorption capacity, and dissipate such stresses down to a harmless residual level.

The polyolefin foam materials utilized according to this invention are produced, for example, by mixing a polyolefin, or a mixture of a polyolefin with an elastomer and/or with synthetic resins, with an organic perioxide as the crosslinking agent and with a blowing agent, wherein the decompostion temperature of the crosslinking agent is below the decomposition temperature of the blowing agent, and optionally with customary additives; shaping the mixture to a shaped article at a temperature lying below the decomposition temperatures of the crosslinking agent and the blowing agent; and subsequently crosslinking and expanding the shaped article by heating same to above the decomposition temperatures of the crosslinking agent and the blowing agent. Such a process has been described, for example, in DAS (German Published Application) No. 1,649,130. The term "polyolefins" as used herein is understood to mean: high-pressure or low-pressure polyethylene, or copolymers consisting essentially of ethylene, as well as mixtures of copolymers and homopolymers. Such copolymers are, for example, ethylene-propylene copolymers, ethylenebutylene copolymers, as well as copolymers of ethylene and vinyl acetate, copolymers of ethylene and acrylic acid esters with alcoholes with 1 to 12 C-atoms, copolymers of ethylene and methacrylic acid esters with alcoholes with 1 to 12 C-atoms, wherein ethylene constitutes from 50 to 95% by weight of the monomeric mixture used fo form the copolymer. Also mixtures of the above-mentioned polyolefins with other elastomers and/or synthetic resins can be used for the invention. This includes, particularly from 60 to 100% of the polyolefin and from 0 to 40% of the other elastomer and/or synthetic resins. Elastomers miscible with polyolefin are, for example, natural rubber, ethylene-propylene elastomer, butyl elastomer, polyisobutylene, styrene butadiene elastomer, polybutadiene, polybutene, and polyisoprene. Synthetic resins miscible with polyolefin are, for example, polystyrene, polypropylene, chlorinated polyethylene, sulfochlorinated polyethylene, or the like.

Preferably, polyethylenes are used as the polyolefins, depending on the structure of the mixture, low-pressure and high-pressure polyethylene, but preferably high-pressure polyethylene having a density of 0.91 to 0.94 g./cc. Suitable organic peroxides are, depending on the composition of the polyolefin, 2,5-dimethyl-2,5-di(tert.-butylperoxy)hexane, tert.-butyl hydroperoxide, cumyl tert.-butyl peroxide, di-tert.-butyl peroxide, and preferably dicumyl peroxide. The peroxides are utilized in amounts of about 1%, i.e. from 0.7 to 1.5%, based on the total mixture to be foamed and shaped. The preferably utilized blowing agent azodicarbonamide has a decomposition temperature above 190° C., which is higher than that of the crosslinking agent. The concentration of the blowing agent is dependent on the desired bulk density of the synthetic resin to be expanded and ranges between 0.5% and 25% weight, based on the total mixture to be foamed and shaped into a molded article; in this procedure, foams are obtained having a bulk density of 20 kg./m$^3$ to 300 kg./m$^3$, depending on the process conditions.

Customary additives ordinarily employed together with synthetic resins on polyolefin basis are, for example, antioxidants, light-protection agents, pigments, fillers, e.g. chalk, flame retardants, antistats, mold release agents, or the like, which can be added to the mixture to be crosslinked and foamed before thermoplastic processing into a synthetic resin foam panel.

For the insulating panels of this invention, preferably a crosslinked polyolefin foam is used having a weight per unit volume of 20–50 kg./m$^3$, and preferably 25–35 kg./m$^3$. These selected foam materials are lightweight with a relatively low weight per unit volume and thus make it possible to manufacture insulating panels of large dimensions which can yet be handled by individual persons. Furthermore, the selected foam material is relatively elastic. The dynamic rigidity of this foam material is, with a thickness of 20 mm. and measured according to DIN (German Industrial Standard) 52 214, between 20 and 25 MN/m$^3$. (MN=mega-Newtons). The compressive stress at 25% deformation, measured according to DIN 53 577, is between 0.05 and 0.08 N/mm$^2$. The elastic synthetic foam material selected according to this invention does not become brittle even down to temperatures of −70° C., so that its preferred properties are fully retained during use. The thickness of the core layer for the insulating panel of this invention is also dependent on the desired heat-insulating values and also depends on the weight per unit volume of the foam material employed. Preferably, this thickness ranges between 20 mm. and 80 mm.

To solve the posed problem of providing a roof covering of insulating panels having an increased sealing function, however, a considerable contributing factor is that the crosslinked, closed-cell polyolefin foam material selected according to this invention, as compared to other foam materials, has a very high water vapor diffusion resistance factor, and the water vapor permeability is extraordinarily low due to the closed cell structure. However, on account of this, the core layer of the insulating panel of this invention takes over simultaneously sealing functions normally exerted only by the sealing sheets of synthetic resin or on a bituminous basis, called roofing skin.

The foam material selected according to this invention for the core layer of the insulating panel has the further advantage that it can readily be processed in every respect, which means, on the one hand, that it can be cut and subdivided without problems, but, on the other hand, can also be bonded by hot-gas welding, flame welding, contact welding, and thermal-impuls welding to itself and to many other materials. Furthermore, crosslinked polyolefin foam material can be glued together with its own kind as well as with other materials, wherein synthetic-resin dispersion glues, adhesives on solvent basis, or solvent-free reactive adhesives on the basis of polyurethane can be utilized. Especially advantageously and non-problematically, however, the crosslinked polyolefin foam material can be laminated to other materials, namely either with the use of hot air, radiators, flame, heated tools, or suitable laminating devices.

In a further development of the insulating panel of this invention, it is suggested to fashion the core layer of at least two crosslinked polyolefin foam panels joined together throughout their contacting surface areas. This provides the possibility of connecting the foam sheets forming the core layer directly or in an offset arrangement with each other, wherein a preferred embodiment resides in connecting the foam layers in a diagonally offset manner with the formation of rabbets extending in each case along two adjoining sides. By the use of two or more foam sheets assembled into the core layer, it is possible to produce in a simple way insulating panels having correspondingly varying thickness, and at the same time the narrow lateral edges can be fashioned to be linear or staggered without requiring additional milling or cutting operations. It is also possible, for example, to produce three-layered cores of polyolefin foam sheets, wherein it is also possible to provide differing weights per unit volume for the individual layers. In addition to simple butt joints or rabbet joints, it is also advantageously possible to use oblique joints and/or wegde-shaped joints with a filling wedge, in order to obtain a mechanical connection.

In a further development of the insulating panel according to the invention, the preferable provision is made that the contacting surface areas of the two crosslinked polyolefin foam panels to be joined together are initially melted by flame and then laminated together. The contacting melted surfaces after being laminated constitute a homogeneous compact polyolefin skin (layer). The surface, compacted by the melting step to bond the foam sheets together, then forms, after the establishment of the bond, a continuous, homogeneous layer showing with regards to its sealing action the behavior of a polyolefin sheet incorporated by laminating. This, however, provides the surprising effect obtained by the insulating panel of this invention, namely that this panel, although it consists only of a core layer of a special synthetic foam material and a sealing sheet laminated thereon, yet contains practically two, mutually independent sealing layers constituting a roofing skin. However, it is also possible to establish the entire-area bonding of two polyolefin foam layers by means of an adhesive having a sealing action, to create in this way a second, continuous sealing layer.

In a further development of the invention, the provision is made that also the joints of the abutting insulating panels, during the production of a roof covering, are optionally joined together not only in a shape-mating way but also in a force-locking way, so that here again a seal is established. This is attained in the insulating panel of this invention, for example, by arranging a sealing means preferably based on coutchouc or EPDM, for example as a bilaterally adhesive strip, in the region of the lateral edges forming the joint surfaces. If the insulating panels are fashioned with a rabbet, then the sealing means is preferably located on a rabbet in the plane of the bonding surface of the foam panels. The sealing means, for example a bilaterally adhesive strip, can be applied already during the manufacture of the insulating panels in the zone of the lateral edges and can be covered with a release paper. However, it is also possible to apply such a sealing means only at the time of installation, i.e. at the building site. The sealing means, for example the bilaterally adhesive strip, then establishes in the joint zone and/or in the horizontal zone of the rabbet, a force-locking tight connection between two adjoining insulating panels. This connection can also be effected under practical conditions by the feature that the foam material utilized as the core layer for the insulating panel is elastic and thus can dissipate any occurring tensile and compressive stresses by pressure deformation.

The insulating panel can be connected on its topside to any desired number of layers, forming a sealing roofing skin, of thermoplastic material, i.e. synthetic resin sheets or sheets having a bituminous base, with firm adhesion over the entire surface, by means of welding, laminating, or cementing, wherein this sealing sheet can be flush with the edges of the insulating panel or can also project at two or more edges.

Preferably, the core layer of crosslinked polyolefin foam is adhesively bonded to synthetic resin sheets on the basis of soft PVC or EPDM, which can be solution welded. All those synthetic resin sheets capable of being solution welded are preferred for use in the construction industry, since joints and overlapping portions, as well as connections, can be established in a simple manner with sufficient tightness and sealing action. However, it is also possible to use synthetic resin sheets, for example on the basis of chlorinated polyethylene, on a bituminous basis, etc.

When using the insulating panel of this invention, a vapor barrier sheet can be omitted during the construction of a roof covering. If requirements must be met with regard to safety against flying sparks and radiant heat, this can be accomplished by the provision of a glass mat, a glass fabric, or an asbestos fiber fabric laminated into the sealing sheet or between the sealing sheet and the core layer.

The production of a roof covering with the insulating panels of this invention takes place starting with the conventional procedure wherein the insulating panels are connected to a substrate and the abutting insulating panels are shape-matingly connected at the rabbets, if present, and the butt joints of the insulating panels are sealed off on the topside with sealing strips by gluing, welding, or the like.

Using the insulating panels of this invention, the process for the production of a roof is further developed by establishing in the joints of adjacent insulating panels a force-locking connection by the introduction of an adhesive and/or by welding. In this way, the process of this invention makes it possible to produce a roof with multiple safety for tightness. In addition to the layer established by the laminated sealing sheets, which are likewise firmly joined along their seams, and representing customarily the only continuous sealing layer, the heat-insulating core layer of the insulating panels of this invention forms a second sealing layer, which is likewise joined into a continuous sealing skin by mechanically closing the butt joints of the adjacent insulating panels. In the production of a roof with the insulating panels according to this invention, these panels can either be laid loosely on a roof base or substrate, wherein then a gravel layer effects the appropriate adherence to the substrate, or it is possible to mechanically attach the panels to the substrate, for example by gluing the insulating panels at least along portions of their surfaces by hot bitumen, hot-melt bitumen sheets, special adhesives, or also flame laminating. For these cases, the additional gravel load can optionally be omitted.

For those cases wherein the insulating panel of this invention is formed with a stepped rabbet, it is suggested to establish the force-locking bond is stepped joints of adjoining insulating panels in the horizontal joint zone by means of a bilaterally adhesive strip and to establish the force-locking bond in the vertical joint zone by the introduction of an adhesive or by means of welding. When using a bilaterally adhesive strip, the latter has the additional advantage that, for example, when the vertical joint is closed by an adhesive, the latter is prevented by this strip from penetration, i.e. leaking through in the downward direction. Thus, locations where the adhesive has escaped and which thus represent a leakage point, are avoided.

The insulating panel of this invention, as well as the process for the production of roof coverings are advantageously usable not only for flat or slightly inclined roofs, but also for roofs showing a greater inclination. Since the insulating panel of this invention can be connected to the substrate mechanically in a simple way, and this bond is not endangered, either, by subsequent alternating temperature stresses, roof inclinations do not represent an obstacle to applying the present invention.

Additional advantageous embodiments of the invention will be explained with reference to the drawings, showing one embodiment, to wit:

Figure 1:
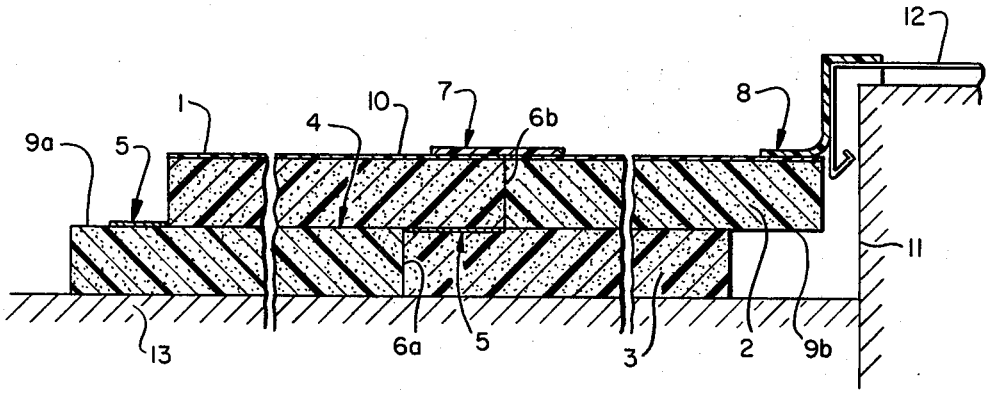
FIG. 1 shows a cross sectional view of a roof structure with insulating panels.

The insulating panels 10 exhibit, in the illustrated examples, a core layer, serving for heat insulating and sealing purposes, made up of two laminated-together, crosslinked, closed-cell polyolefin foam sheets 2, 3, made of polyethylene; this core layer is bonded on the topside adhesively over its entire area to the sealing sheet 1, for example a soft PVC sheet, which is effected, for example, be cementing or gluing. Preferably, a hydroxy-group-containing, crosslinking acrylic resin adhesive which simultaneously forms a barrier against plasticizer migration, e.g. is utilized for gluing the soft PVC sealing sheets to the crosslinked polyolefin foam. The two foam sheets 2,3 are bonded in the area 4 throughout adhesively by flame laminating, wherein this area forms, due to the initial melting thereof, a homogeneous polyolefin layer having, with respect to its sealing action, the behavior of a polyolefin sheet incorporated at that location by laminating. In the illustrated embodiment, the foam sheets 3 are joined in a diagonally offset fashion, as can also be derived from the view of FIG. 2, thus forming the staggered rabbets 9*a* and 9*b*, respectively, extending along respectively two adjoining sides. The staggered rabbet 9*a* is provided in the horizontal surface with the bilaterally adhesive strip 5 formed of coutchouc or EPDM which is covered, until the final connection is established, on the topside with a release liner, not illustrated in detail. The bilaterally adhesive strip 5 can fill the entire horizontal joint or also only a portion thereof. The insulating panels 10 in the illustrated example are bonded over their entire lower surface areas with the substrate 13 by means of a special adhesive, e.g. bitumen or acrylic adhesives or polyurethane adhesives or epoxy adhesives. The butting insulating panels 10 are shape-matingly connected via the stepped rabbet 9*a*, 9*b* and are connected force-lockingly by means of the bilaterally adhesive strip 5. Furthermore, the provision is made that the upper vertical butt joint 6*b* is likewise closed force-lockingly by injecting an adhesive or a hot-melt adhesive, e.g. coutchouc modified bitumen, EPDM-adhesive, chloroprene coutchouc adhesives or as hot melts, e.g. ethylene vinyl acetate or polyamide hot melts or by establishing a welding bond by heat or by solution welding with an appropriate solvent, e.g. a mixture of toluene and gasoline. In this connection, the sealing means 5 in the horizontal joint zone has the additional task of preventing adhesive injected, for example, into the joint 6*b* from leaking through to the substrate or from escaping, so that the butt joint 6*b* can with certainty be sealingly closed throughout its area. On the topside, the sealing sheets 1 can be covered, for example, by means of cover strips 7 which are likewise adhesively applied throughout their surface area, e.g. by solution welding or gluing. In the same way, sealing connections can be established at the masonry 11 along the edges by means of cover strips 8 or, for example, by means of metal foil angles 12 coated with synthetic resin sheets.

The roof which can be produced with the aid of the insulating panel of this invention exhibits triple safety with regard to the sealing functions. The first safety feature is provided by the sealing sheets 1 laminated to the insulating panels 10. However, if this sealing sheet 1, which is also frequently called a roofing skin, happens to be damaged, then the next feature is activated, in the form of the full-area sealing effect of the core layers 2, 3 of crosslinked, closed-cell polyolefin foam material, constituting the heat insulation. These core layers 2, 3 are tight not only in the vertical extension, i.e. in the direction of their thickness, but also exhibit a continuous tightness throughout their horizontal extension by the mechanical and force-locking connection of the butt joints. This tightness is effected by the selected, crosslinked, closed-cell polyolefin foam material. However, if due to major mechanical damage, amounts of water should also penetrate into the core layer 2, then these amounts are checked at the bond surface 4, constituting a homogeneous, compressed polyolefin layer. Even if these sealing surfaces 4 were to be penetrated, there still remains the core layer 3 disposed therebelow, with its sealing effect. This, taken in total, means that with the insulating panel of this invention and its installation on a roof, the danger of leakage becomes substantially smaller, and the lifetime of the covered roof is substantially increased over that of known roof coverings.

Figure 2:
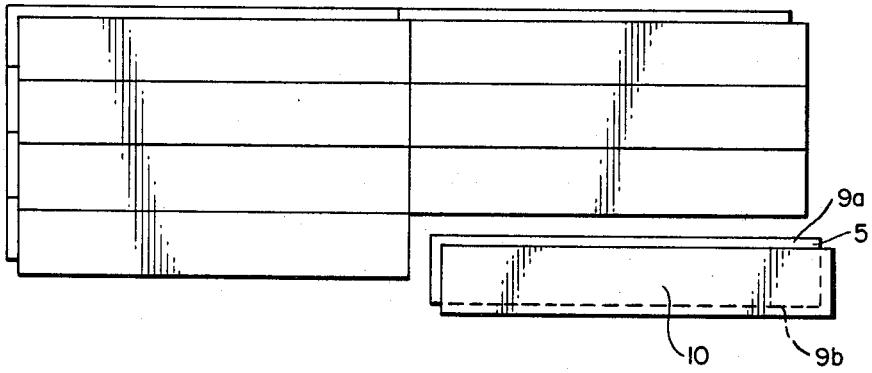
FIG. 2 shows a top view of the insulating panels.

FIG. 2 shows schematically a top view of several insulating panels 10 combined into a larger unit. The dimensions of the insulating panel can be as desired. However, advantageously, rectangular insulating panels are prefabricated on the order of, for example, 1 m.×5 m. or larger, which still can be handled by individual persons due to the selected materials.

Figure 3:
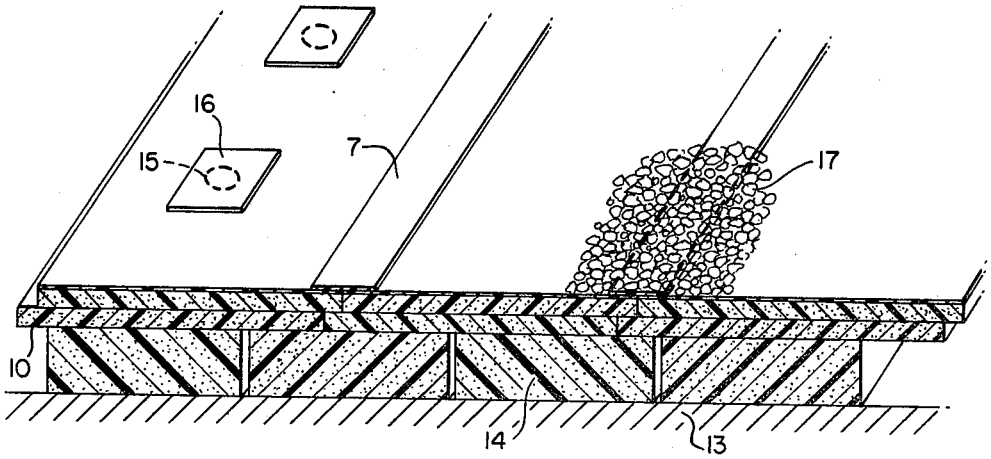
FIG. 3 shows the structure of a thermally insulated roof.

The insulating panels of this invention can also be partially combined, for example, with conventional roof installations, e.g. for producing a heat-insulated roof, as schematically illustrated in FIG. 3. In this embodiment, a first heat-insulating layer of hard foam panels, e.g. styrofoam panels 14, is loosely juxtaposed on substrate 13. On top of these panels 14, the insulating panels 10 of this invention are then placed likewise in a loose fashion, and then are mechanically and force-lockingly joined along their butt joints by means of sealing strip and adhesive, as explained, for example, in connection with FIG. 1. On the topside, the butt joints of the insulating panels 10 are sealingly closed by means of the cover strips 7. The thus-produced heat-insulating roof structure can be secured against wind lift-off, for example, by pouring a gravel load 17 thereon or by the insertion of setscrews 15 at intervals, which screws penetrate the insulating panels 10 and the panels 14 and are screwed tightly into the substrate 13. The setscrews 15 are then covered on the topside by means of synthetic resin sheets 16, which are glued or welded thereon.

Figure 4:
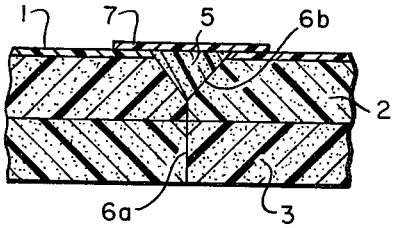
FIGS. 4 and 5 show joint connections.
Figure 5:
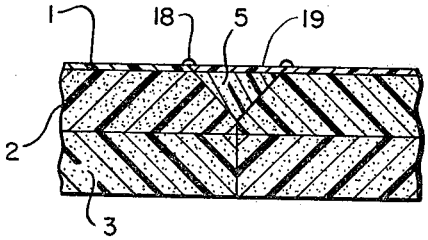

FIGS. 4 and 5 show schematically additional mechanical joint connections for the insulating element of this invention. In FIG. 4, a wedge-shaped recess is provided in the butt joint 6*a*, 6*b* on the topside; the filling wedge strip 5, likewise consisting preferably of crosslinked polyolefin foam material, is inserted in this recess as the sealing means, and is sealingly and adhesively connected to the joint zone to the insulating element 1, for example, by gluing or welding with heat.

The joint can then be sealingly closed, in turn, on the topside by means of a cover strip 7 of synthetic resin sheet of the same material as the sealing sheet. However, it is also possible, as shown, for example, in FIG. 5, to employ a sealing means 5 which is already laminated on the topside with a synthetic resin sheet having a sealing action, so that, for example, only an additional safety means must be provided in the transition zone by means of liquid film 18 to produce a homogeneous, continuous roofing skin 1. In case the joints are formed with inclined surfaces, i.e. unilaterally inclined or wedge-shaped, it is readily possible to apply the contact pressure required for establishing the sealing connection during the welding or gluing step.

Figure 6:
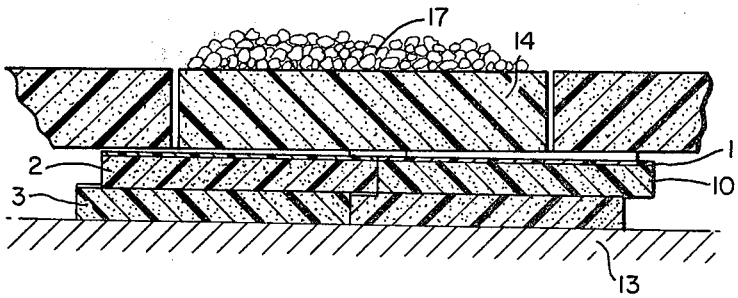
FIG. 6 shows a cross sectional view of another roof structure.

FIG. 6 shows another roof structure, where the insulating panel 10 comprising two-laminated-together crosslinked closed-cell polyolefin foam sheets 2, 3 and on the topside adhesively bonded over its entire area the sealing sheet 1 lays on the substrate 13. If the roof has a gravel load 17 the panels 10 may loosely lay on the substrate, however, they may be partially or over their entire lower surface bonded by adhesives or glueing or welding to the substrate 13; on the insulating panel 10 is laying a heat insulating layer of foam panels 14, like, e.g. Styrofoam panels or polyurethane panels, loosely juxtaposed. On the top of these panels 14 is poured the gravel load 17, securing the whole roof structure against wind-lift-off.

What is claimed is:

1. An insulating panel comprising a core layer of a synthetic foam material bonded adhesively on its topside to a sealing thermoplastic layer or sheet throughout the surface area of the topside for the covering of roof structures, said core layer comprising at least two superimposed foam sheets of an elastic, closed-cell crosslinked polyolefin foam material, said sheets being bonded together throughout the contacting surface areas by flame laminating, the bonding surfaces of the foam, initially melted by the flame laminating, together constituting a homogeneous polyolefin layer.

2. An insulating panel according to claim 1, wherein the foam layers are bonded together in a diagonally offset fashion with the formation of rabbet edges extending respectively along two adjoining sides.

3. An insulating panel according to claim 2, wherein a sealing means, comprising bilaterally adhesive strip, is arranged on a rabbet in the plane of the bonding surfaces of the foam sheets.

4. An insulating panel according to claim 1, wherein the polyolefin foam material is a crosslinked polyolefin foam having a weight per unit volume of 20–50 kg./m$^3$.

5. An insulating panel according to claim 1, wherein the core layer is adhesively bonded to synthetic resin sheet material formed of soft PVC or ethylene-propylene-diene elastomer.

6. An insulating panel according to claim 1, wherein the homogeneous polyolefin layer is a compressed layer that forms a sealing surface layer between the two superimposed foam sheets.

7. An insulating panel according to claim 1, wherein the crosslinked polyolefin foam material comprises polyethylene.

* * * * *